US008459600B2

(12) United States Patent
Tarr

(10) Patent No.: US 8,459,600 B2
(45) Date of Patent: Jun. 11, 2013

(54) TRESTLE STABILIZING DEVICE

(76) Inventor: Robert J. Tarr, Willoughby, OH (US)

( * ) Notice: Subject to any disclaimer, the term of this patent is extended or adjusted under 35 U.S.C. 154(b) by 436 days.

(21) Appl. No.: 12/057,833

(22) Filed: Mar. 28, 2008

(65) Prior Publication Data

US 2008/0237431 A1 Oct. 2, 2008

Related U.S. Application Data

(60) Provisional application No. 60/921,209, filed on Mar. 30, 2007.

(51) Int. Cl.

| | |
|---|---|
| ***E04G 25/00*** | (2006.01) |
| ***E04G 3/00*** | (2006.01) |
| ***A47H 1/14*** | (2006.01) |
| ***A47H 13/00*** | (2006.01) |

(52) U.S. Cl.
USPC ..... 248/200.1; 248/229.13; 248/251; 248/440; 211/124

(58) Field of Classification Search
USPC ..... 248/200.1, 354.1–354.3, 188.2–188.5, 248/343, 214–215, 229.13, 229.14, 251, 248/440; 211/124, 123, 105.3; 206/291, 279, 206/289, 298; 52/719
See application file for complete search history.

(56) References Cited

U.S. PATENT DOCUMENTS

| | | | | |
|---|---|---|---|---|
| 2,803,349 | A * | 8/1957 | Talbot | 211/22 |
| 2,962,252 | A * | 11/1960 | Frank | 248/231.81 |
| 4,114,326 | A * | 9/1978 | Macuga et al. | 52/28 |
| 5,312,405 | A * | 5/1994 | Korotko et al. | 606/278 |
| 5,482,239 | A * | 1/1996 | Smith | 248/229.13 |
| 5,497,926 | A * | 3/1996 | Rittenhouse | 224/407 |
| 7,735,794 | B1 * | 6/2010 | Gretz | 248/343 |
| 7,810,775 | B2 * | 10/2010 | Dal Ponte et al. | 248/343 |
| 7,891,619 | B2 * | 2/2011 | Perlman | 248/229.14 |
| 2008/0237431 | A1 * | 10/2008 | Tarr | 248/440 |

* cited by examiner

*Primary Examiner* — Tan Le
(74) *Attorney, Agent, or Firm* — Fay Sharpe LLP

(57) ABSTRACT

A trestle stabilizing device is provided for a model track assembly having support apparatuses or trestles for elevating track sections. The device includes a base including a first end section and a second end section. A first fastening member is connected to the first end section. A second fastening member is connected to the second end section. The first and second fastening members releasably secure the device to the track support apparatuses.

20 Claims, 10 Drawing Sheets

TRESTLE STABILIZING DEVICE

CROSS REFERENCE TO RELATED APPLICATIONS

This application claims priority from U.S. Provisional Patent Application Ser. No. 60/921,209 filed Mar. 30, 2007, which is expressly incorporated herein by reference, in its entirety.

BACKGROUND

The present disclose generally relates to a model track assembly, and specifically to a stabilizing device suitable for stabilizing conventional trestles associated with the model track assembly. However, it is to be appreciated that the present disclosure is also amenable to other applications.

Hobby enthusiasts for many years have enjoyed the operation of model railroad trains of the type in which separate track sections are removably joined together to form a closed path designed by the hobbyist over which a model train will travel. In the simplest form, a section of track includes a pair of spaced apart, electrically conductive rails and an arrangement of ties extending between the rails, the rails being joined together to form the track section into the desired configuration. The rails form a closed electrical circuit when the track sections are joined together in a closed configuration or pattern. Means are provided for supplying electrical energy to the rails of the assembled track sections to energize the model train traveling thereon. The track sections range in size and shape. There are countless possibilities for individual track sections: some are straight; some feature switching mechanisms; some are curved having various radii; and, some are ascending for connection to another track positioned at a higher level.

Generally, track support apparatuses, such as conventional trestles, are used to support such elevated track sections. Trestles may be used individually but are typically arranged in series. For example, a typical figure-8-shaped course includes elevated track sections which cross at the center of the figure-8 at differing levels. The track sections are supported at an incline and decline by gradually ascending and descending trestles. However, conventional trestles can fail to provide adequate stability to elevated track sections. For example, one of the problems facing designers today during setup of a model railroad track display is inadvertent contact of the elevated track sections and supporting trestles. Such contact can cause the trestles to topple, which in turn, collapses the track sections.

Accordingly, the present invention relates to a trestle stabilizing device which provides adequate stability to supporting trestles.

BRIEF DESCRIPTION

In accordance with one aspect of the present disclosure, a trestle stabilizing device is provided for a model track assembly having support apparatuses or trestles for elevating track sections. The device includes a base including a first end section and a second end section. A first fastening member is connected to the first end section. A second fastening member is connected to the second end section. The first and second fastening members releasably secure the device to the track support apparatuses.

In accordance with another aspect of the present disclosure, a trestle stabilizing device includes a base including a first elongated member and a second elongated member. The second elongated member is slidably mounted in relation to the first elongated member. A first fastening member is pivotally connected to the first elongated member. A second fastening member is pivotally connected to the second elongated member. The first and second fastening members are configured to releasably secure the device to adjacent, spaced apart trestles to prevent toppling of one of the trestles relative to the other of the trestles.

In accordance with yet another aspect of the present disclosure, a trestle stabilizing device includes a first elongated member and a second elongated member coupled to the first elongated member. The first elongated member has an end section connected to a first trestle. The second elongated member has an end section connected to a second trestle. A locking structure is configured to selectively lock the second elongated member in a desired position in relation to the first elongated member. The first and second elongated members prevent toppling of one of the first and second trestles relative to the other of the first and second trestles.

Still other aspects of the present disclosure will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

DETAILED DESCRIPTION

Figure 1:
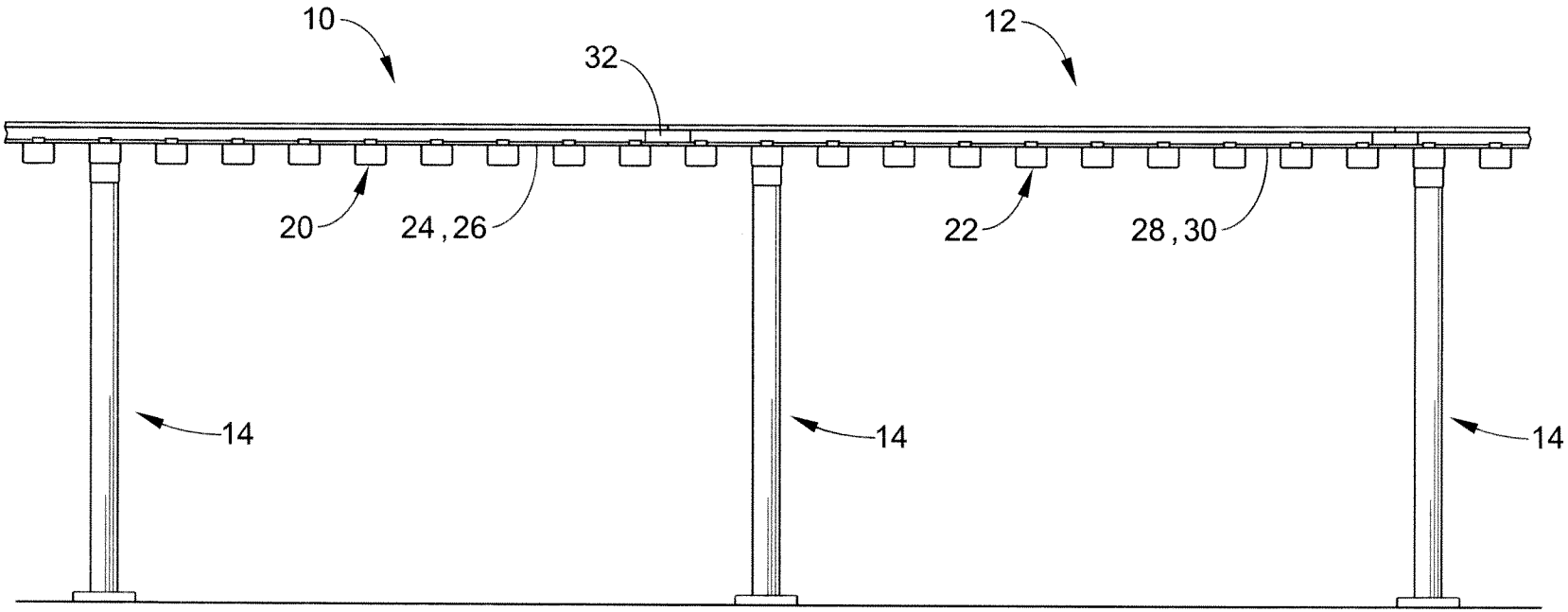
FIG. 1 is a side elevational view of connected, elevated track sections secured to spaced apart adjacent support apparatuses or trestles.

It should, of course, be understood that the description and drawings herein are merely illustrative and that various modifications and changes can be made in the structures disclosed without departing from the scope and spirit of the present disclosure. All references to direction and position, unless otherwise indicated, refer to the orientation of the trestle stabilizing device illustrated in the drawings and should not be construed as limiting.

Referring now to the drawings, wherein like numerals refer to like parts throughout the several views, FIG. 1 illustrates two sections of model railroad tracks 10 and 12 joined together, elevated and supported on spaced apart conventional support apparatuses or trestles 14. In the depicted embodiment, each section of track includes an array of model railroad ties 20, 22. Rails 24 and 26 and rails 28, and 30 are positioned in a spaced apart relationship on the tie arrays 20 and 22, respectively. Fishplates or rail joiners 32 are secured to the ends of the rails for releasably securing the track sections 10, 12 together. The ties are generally box-like and include cavities (not shown) for receiving a top portion of the trestle 14. Further details of the above track sections and trestles are generally conventional and understood by one skilled in the art so that further discussion herein is deemed unnecessary.

Figure 2:
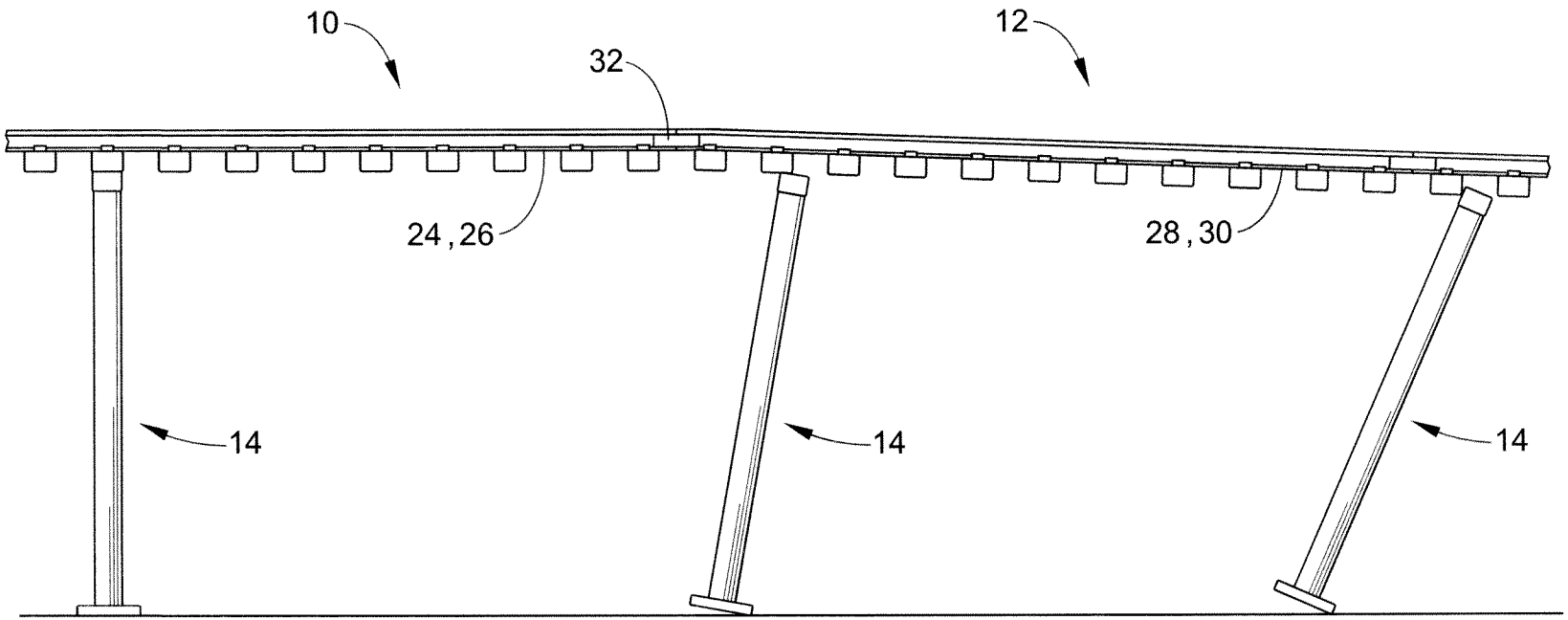
FIG. 2 is a side elevational view of two of the trestles of FIG. 1 being toppled by inadvertent contact.
Figure 3:
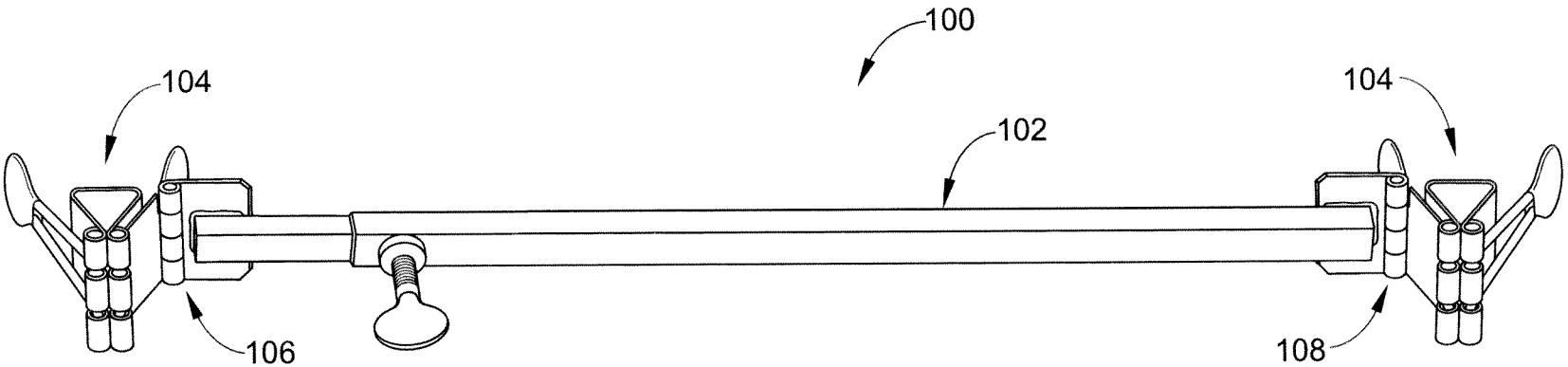
FIG. 3 is a perspective view of a trestle stabilizing device according to one aspect of the present disclosure.

With reference to FIG. 2, and as indicated previously, the trestles 14 can fail to provide adequate stability to the elevated track sections 10, 12. For example, inadvertent contact with the track sections 10, 12 and/or trestles 14 during setup and operation can cause the trestles to topple, which in turn, collapses the track sections. In order to prevent the toppling of a model railroad track display, and as shown in FIG. 3, a trestle stabilizing device, generally designated by reference numeral 100, in accordance with one aspect of the present disclosure, can be selectively secured to adjacent, spaced apart trestles 14 (see FIG. 6).

Figure 4:
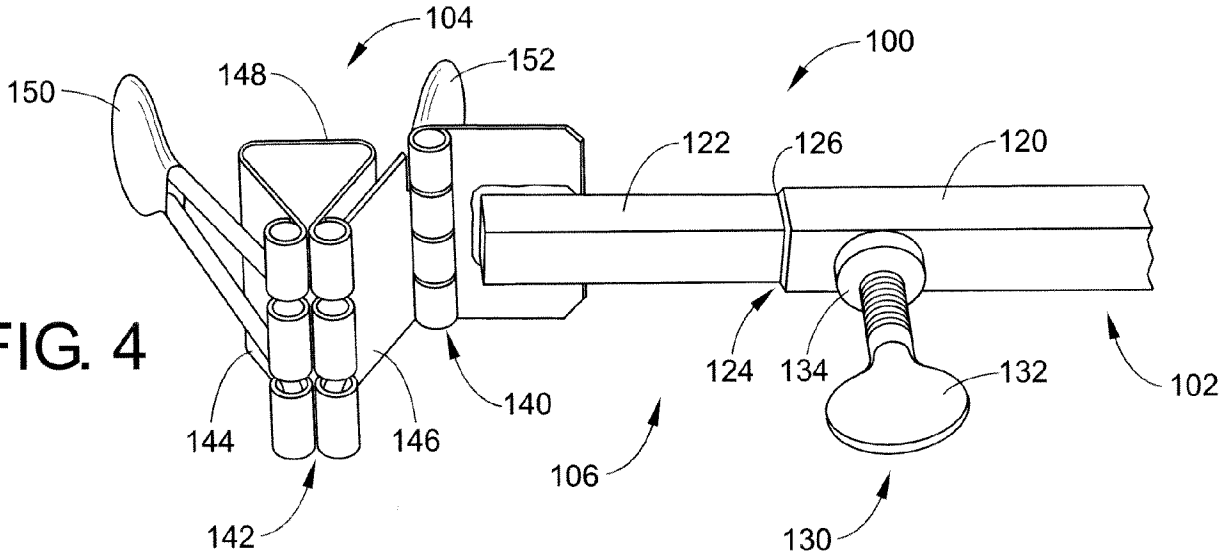
FIG. 4 is an enlarged perspective view of an end section of the trestle stabilizing device of FIG. 3 in a first position.
Figure 5:
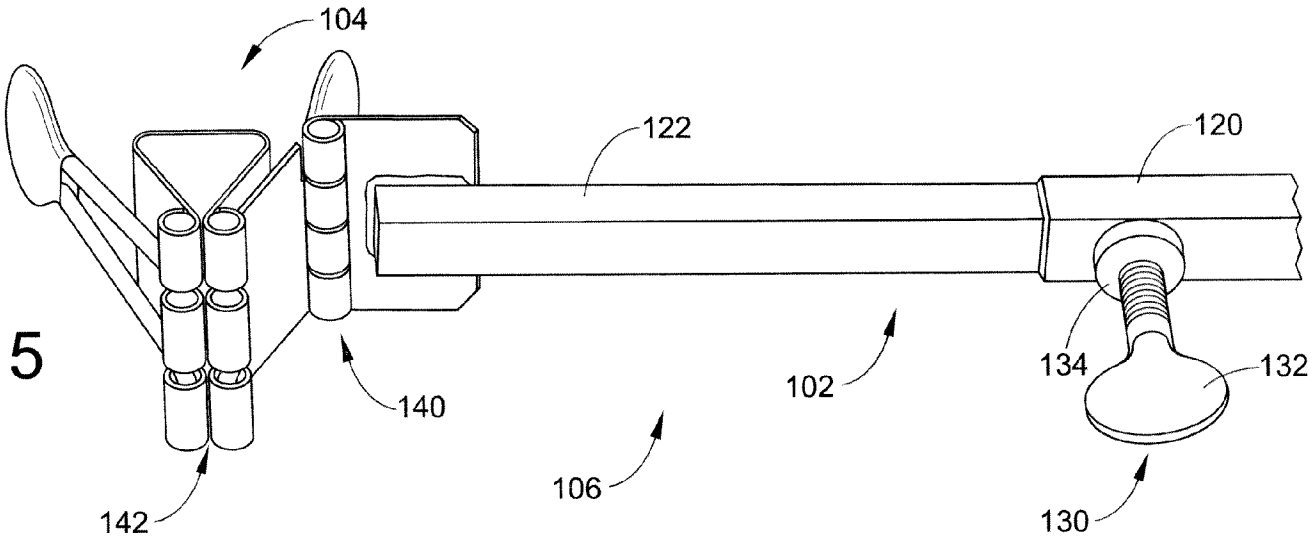
FIG. 5 is an enlarged perspective of the end section of the trestle stabilizing device of FIG. 4 in a second position.

The trestle stabilizing device 100 generally comprises a longitudinally extending, axially adjustable base 102 and fastening members 104 pivotally secured to respective end sections 106, 108 of the base. As shown in FIGS. 4 and 5, the base 102 includes a first elongated member 120 and a second elongated member 122, which is slidably mounted in relation to the first elongated member. The first elongated member 120 includes a first longitudinal axis and the second elongated member 122 includes a second longitudinal axis, the first longitudinal axis being generally coaxial with the second longitudinal axis. The first elongated member 120 includes a channel 124 extending at least partially therethrough. The channel has an open end 126 for at least partially telescopically receiving the second elongated member 122, a portion of the second elongated member projecting from the first elongated member. In the depicted embodiment, the first and second elongated members have generally rectangular cross-sections. However, it should be appreciated that alternate configurations of the elongated members 120, 122 are contemplated. For example, the elongated members of the present invention may be configured to have round, triangular, hexagonal, octagonal, etc. cross-sections. Further, the elongated members 120, 122 can be molded to have a trestle-like configuration similar to conventional trestles.

Figure 6:
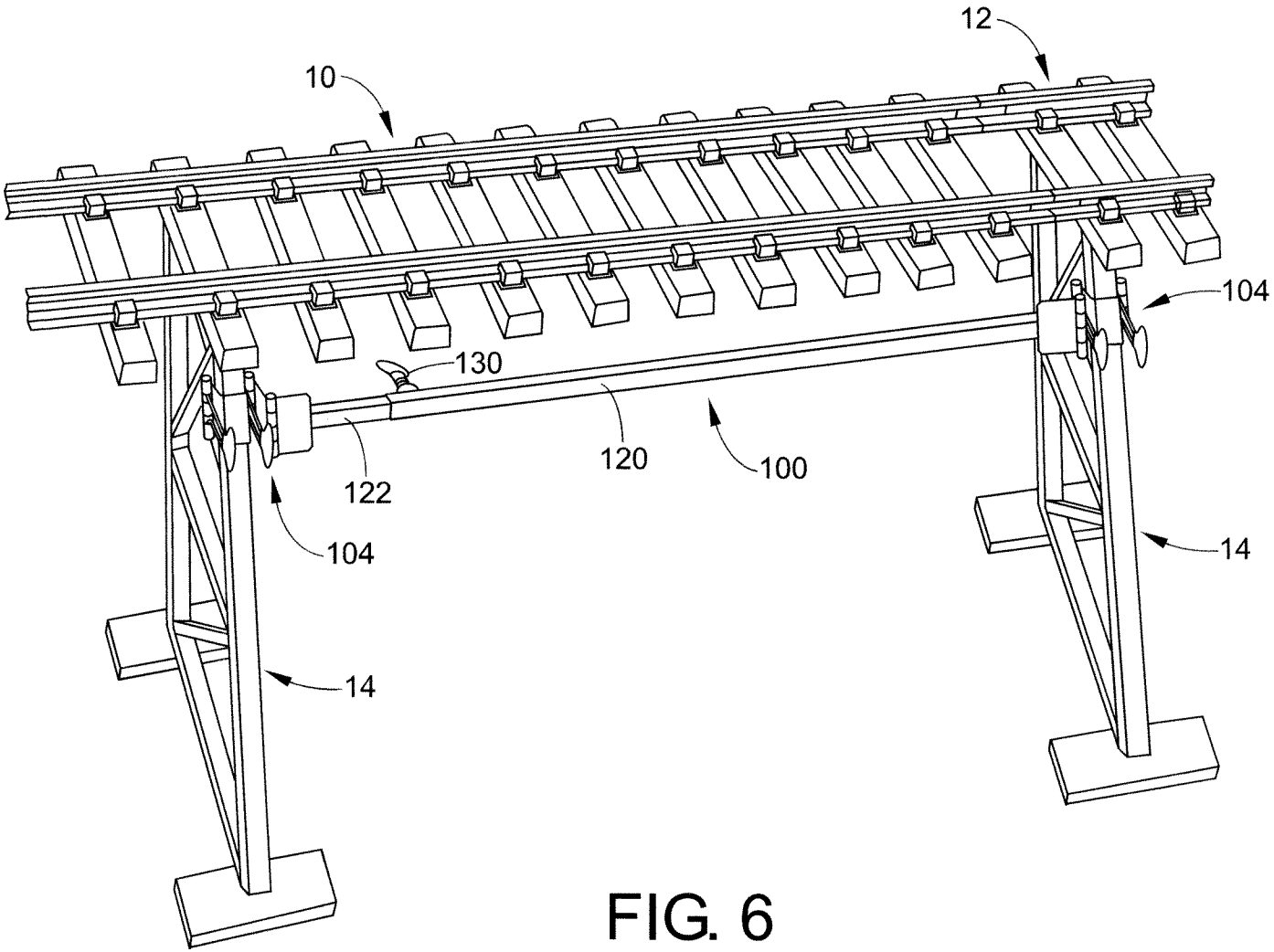
FIG. 6 is a perspective view of the trestle stabilizing device of FIG. 3 selectively secured to adjacent trestles of FIG. 1.

A locking structure 130 is coupled to the base 102, particularly in the depicted embodiment the first elongated member 120, for selectively locking the second elongated member 122 in a desired position in relation to the first elongated member 120. The locking structure allows for the selective movement of the second elongated member 122 within the channel 124 of the first elongated member 120. In the depicted embodiment of FIGS. 4 and 5, the locking structure 130 includes a fastener 132, such as a thumb screw, which can be threaded into a threaded opening 134 located adjacent the open end 126 of the channel 124 such that an end section (not shown) of the fastener 132 engages the second elongated member 122. This, in turn, prevents the longitudinal movement of the second elongated member within the channel. Thus, the fastener engages the second elongated member 122 to secure the second elongated member at a desired location in relation to the first elongated member. As shown in FIG. 6, this allows the trestle stabilizing device 100 to be connected to adjacent trestles 14 which are spaced apart at varying lengths.

It should be appreciated that alternate manners for selectively securing the second elongated member 122 within the channel 124 of the first elongated member 120 are contemplated. For example, an outwardly biasing spring-loaded clip portion (not shown) can be inserted within a second end of the second elongated member 122 so that an outwardly biasing button portion (not shown) selectively projects through a single aperture of a plurality of arrayed openings (not shown) located on the overlapping first elongated member 120. The overall length of the trestle stabilizing device 100 may be adjusted simply by pressing the button portion inwardly and then axially sliding the first and second elongated members 120, 122 relative to one another until a desired opening of the plurality of openings aligns over the single aperture, at which point the button portion will again project downwardly through the aperture and one of the plurality of openings snapping the first and second elongated members in place.

With reference again to FIGS. 4 and 5, each fastening member 104 is hingedly or pivotally connected to a respective end section 106 and 108, and is configured for releasably securing the stabilizing device 100 to the adjacent, spaced apart trestles 14. In this embodiment, a hinge member 140 is provided for connecting each fastening member to the base 102; although, alternative manners for pivotally connecting the fastening member to the base are contemplated. As shown, the hinge member 140 has one end portion connected to the base 102 and the other end portion connected to the fastening member. The hinge member allows for radius of curvature thereby allowing the trestle stabilizing device 100 to be connected to adjacent trestles associated with curved portions of a track display having various radii.

Figure 7:
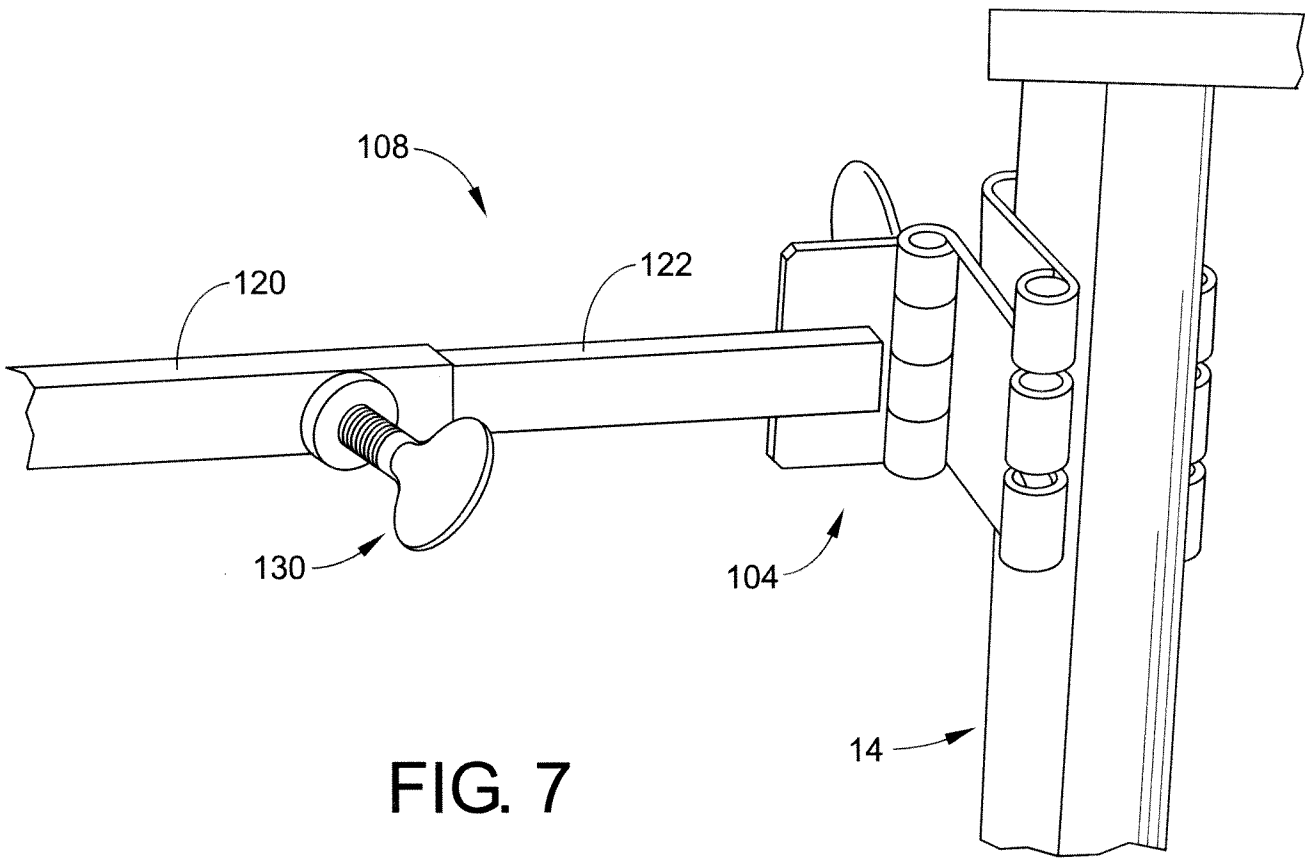
FIG. 7 is an enlarged perspective view of a secured end section of the trestle stabilizing device of FIG. 6.

In the depicted embodiment, the fastening member 104 includes a resilient clamp or clip 142. The clip comprises a pair of flat holding members or engagement members 144, 146 connected by an end wall 148. The holding members are configured so that leading edges thereof are normally resiliently pressed against each other. In order to open the clip 142 or to move the leading edges away from each other for holding a portion of the trestle 14, the clip is provided with a pair of levers 150, 152. When one grips the levers between his or her fingers and pushes them toward each other, the clip is opened. As shown in FIGS. 6 and 7, a portion of the trestle 14 is then inserted between the holding members 144, 146 and the levers 150, 152 are released, thereby securing the trestle in the clip. Although the trestle stabilizing device 100 is shown as being connected to upper portions of the trestles 14 adjacent sides of the track sections; it should be appreciated that the stabilizing device 100 can be connected at alternate locations to stabilize the trestles. For example, the stabilizing device can be connected at lower portions of the trestles and/or upper portions of the trestles under the ties of the track sections.

The trestle stabilizing device 100 can be made of a suitable conventional thermoplastic material, such as a relatively rigid plastic, so that its components are formed in a single molding operation. Of course, it should be recognized that one or more of these components could also be made from any other conventional type of material, such as metallic and composite materials.

Figure 8:
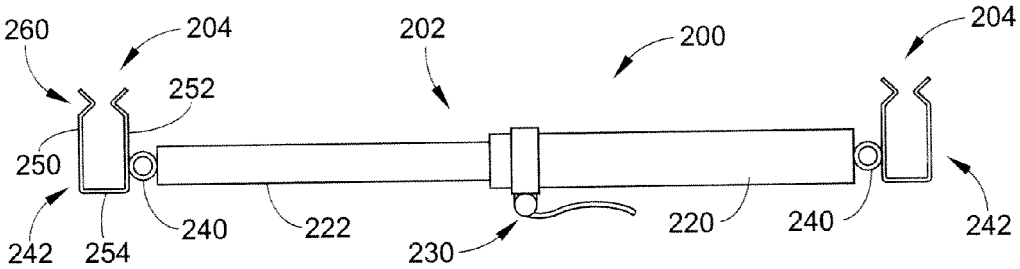
FIG. 8 is a top plan view of a trestle stabilizing device according to a second aspect of the present disclosure.

In accordance with another aspect of the present disclosure, and as shown in FIG. 8, a trestle stabilizing device 200 generally comprises a longitudinally extending, adjustable base 202 and fastening members 204 pivotally secured to respective end sections of the base. The base includes a first elongated member 220 and a second elongated member 222 at least partially telescopically received in the first elongated member 220. A locking structure 230, such as a quick release clamp, is coupled to the base 202 which allows for the selective movement of the second elongated member 222 within the first elongated member 220. The fastening members 204 comprise a hinge member 240 having one end portion connected to the base and the other end portion connected to a resilient clamp 242. The clamp includes a pair of resilient rectilinear legs or engagement members 250, 252 joined by an end wall 254. Inward prongs 260 are provided on each leg to engage the trestle and prevent downward and outward slippage.

Figure 9:
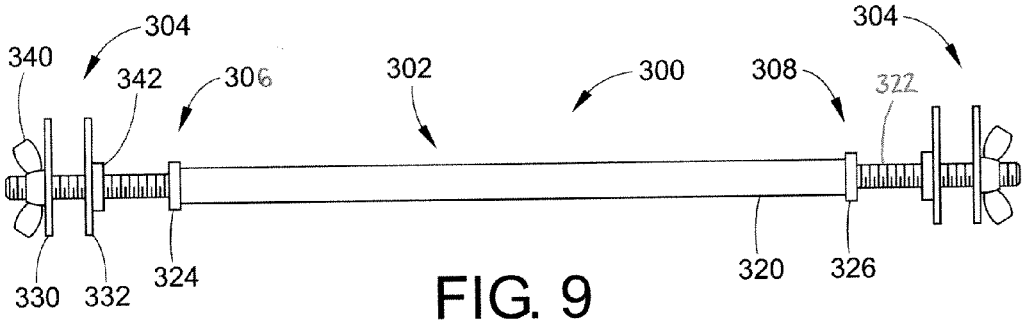
FIG. 9 is a top plan view of a trestle stabilizing device according to a third aspect of the present disclosure.

In accordance with yet another aspect of the present disclosure, and as shown in FIG. 9, a trestle stabilizing device 300 generally comprises base 302 and longitudinally extending, adjustable fastening members 304 secured to respective end sections 306, 308 of the base. The base includes a first elongated member 320 and a second, threaded elongated member 322. The second elongated member is threaded though end caps 324, 326 mounted to the respective end sections 306, 308. Each fastening member 304 includes a pair of plates 330, 332 and a pair of nuts 340, 342, one of which can be a wing nut 340. The plates includes an opening (not shown) dimensioned to receive the second elongated member. In use, the plates are axially positioned on the second elongated member such that a trestle can be secured between the plates. Once positioned, the nuts threadingly engage the plates thereby compressing the trestle between the plates.

Figure 10:
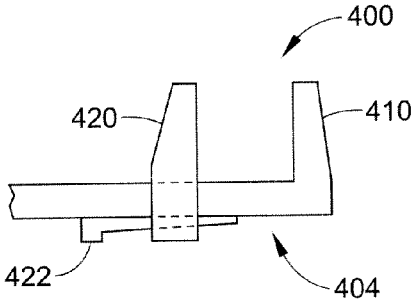
FIG. 10 is a partial top plan view of a trestle stabilizing device according to a fourth aspect of the present disclosure.

In accordance with still yet another aspect of the present disclosure, and as shown in FIG. 10, a trestle stabilizing device 400 includes a base, which can be axially adjustable. End portions (only right end portion 404 is illustrated) of the base include an outwardly extending first stop member 410. A second stop member 420 is moveably mounted over the base. In use, a trestle is positioned between the stop members. The second stop member is pressed against the trestle. A wedge member 422 is then wedged between the base and the second stop member which prevents axial movement of the second stop member.

Figure 11:
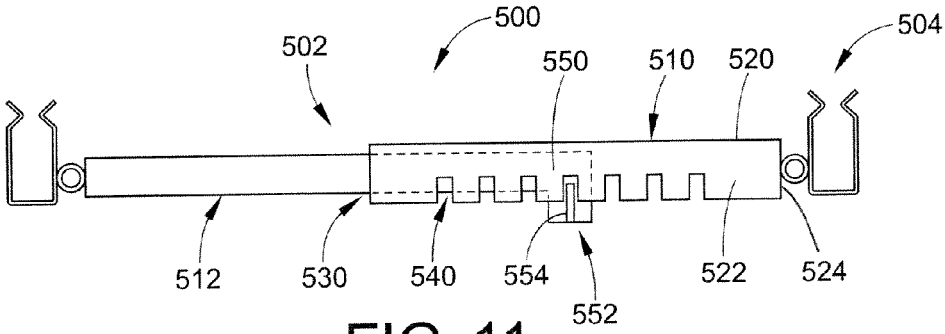
FIG. 11 is a top plan view of a trestle stabilizing device according to a fifth aspect of the present disclosure.

In accordance with still yet another aspect of the present disclosure, and as shown in FIG. 11, a trestle stabilizing device 500 generally comprises a longitudinally extending, adjustable base 502 and fastening members 504 (similar to fastening members 204) pivotally secured to respective end sections of the base. The base includes a first elongated member 510 and a second elongated member 512. The first elongated member includes a base section 520, a pair of generally parallel arm sections 522 extending therefrom and an end wall 524. The base section and the arm sections define a first generally U-shaped channel. The U-shaped channel has an open end 530 opposite the base section for telescopically receiving the second elongated member 512.

Each arm section 522 includes at least one tab (not shown) extending inwardly from an inner surface of the arm section. The tab holds a cooperating bottom portion of the second elongated member within the first U-shaped channel. Each arm section 522 further includes a plurality of adjustment notches 540 disposed along a bottom portion of the arm sections. The notches allow for the selective movement of the second elongated member 512 within the first U-shaped channel of the first elongated member 510.

An end portion 550 of the second elongated member 512 includes a pair of downwardly extending resilient tabs 552. Each tab includes a protrusion 554. The protrusions are dimensioned to be received in the notches 540 of the first elongated member 510. The protrusions can be selectively engaged with one of the notches to secure the second elongated member at a desired location in relation to the first elongated member.

Figure 12:
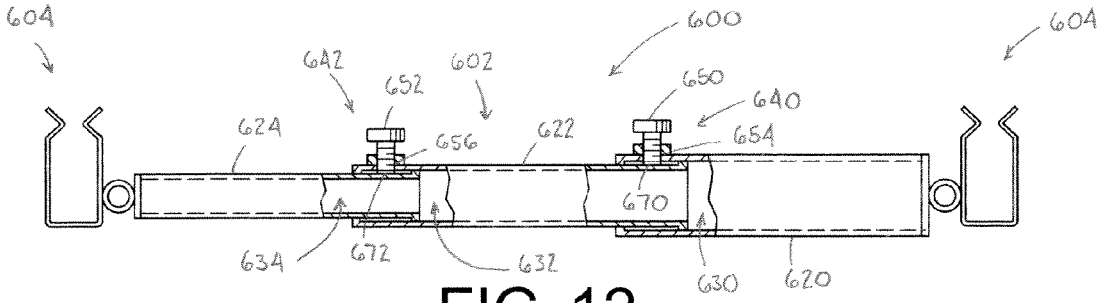
FIG. 12 is a top plan view, partially broken away, of a trestle stabilizing device according to a sixth aspect of the present disclosure.

In accordance with another aspect of the present disclosure, and as shown in FIG. 12, a trestle stabilizing device 600 generally comprises a longitudinally extending, adjustable base 602 and fastening members 604 (similar to fastening members 204) pivotally secured to respective end sections of the base. The base includes a first elongated member 620, a second elongated member 622 at least partially telescopically received in the first elongated member 620, and a third elongated member 624 at least partially telescopically received in the second elongated member 622. Each elongated member 620, 622, 624 includes a respective hollow interior or channel 630, 632, 634. Although, it should be appreciated that the third elongated member can be a solid body. The interior 630 of the first elongated member 620 accommodates at least a portion of the second elongated member 622. The interior 632 of the second elongated member 622 accommodates at least a portion of the third elongated member 624.

A first locking structure 640 is coupled to the first elongated member 620 which allows for the selective movement of the second elongated member 622 within the first elongated member 620. A second locking structure 642 is coupled to the second elongated member 622 which allows for the selective movement of the third elongated member 624 within the second elongated member. Each locking structure 640, 642 includes a fastener 650, 652 which can be threaded into a threaded opening 654, 656 located on the first and second elongated members 620, 622. An end section 670 of fastener 650 engages the second elongated member 622. This, in turn, prevents the longitudinal movement of the second elongated member within the interior 630 of the first elongated member 620. An end section 672 of fastener 652 engages the third elongated member 624. This, in turn, prevents the longitudinal movement of the third elongated member within the interior 632 of the second elongated member 622.

Figure 13:
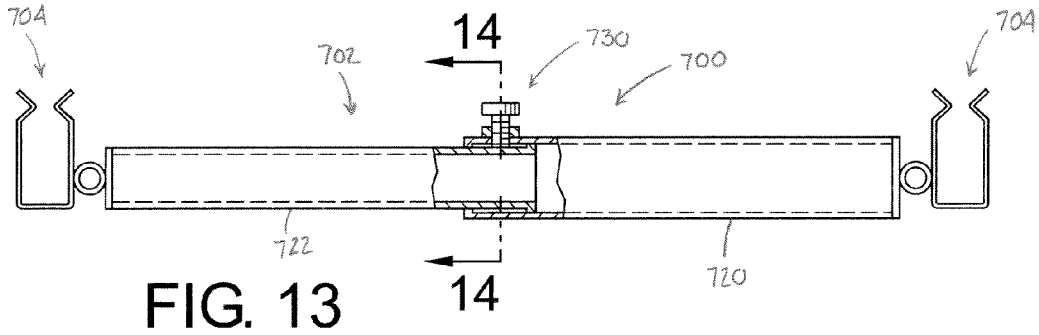
FIG. 13 is a top plan view, partially broken away, of a trestle stabilizing device according to a seventh aspect of the present disclosure.
Figure 14:
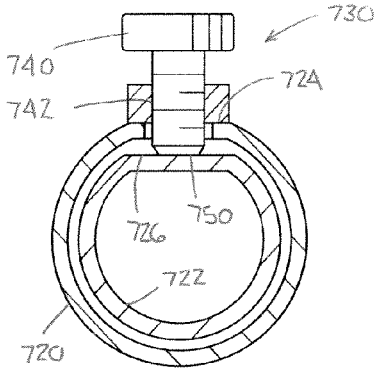
FIG. 14 is a cross-sectional view of the trestle stabilizing device of FIG. 13 taken generally along line 14-14 of FIG. 13.

In accordance with another aspect of the present disclosure, and as shown in FIGS. 13 and 14, a trestle stabilizing device 700 generally comprises a longitudinally extending, adjustable base 702 and fastening members 704 pivotally secured to respective end sections of the base. The base includes a first elongated member 720 and a second elongated member 722 at least partially telescopically received in the first elongated member. Each elongated member 720, 722 is generally D-shaped in cross-section and includes a planar section 724, 726. A locking structure 730 is coupled to the planar section 724 of the first elongated member. Similar to the previous embodiment, the locking structure includes a fastener 740 which can be threaded into a threaded opening 742 located on the first elongated member. An end section 750 of the fastener engages the planar section 726 of the second elongated member, which allows for the selective movement of the second elongated member within the first elongated member.

Figure 15:
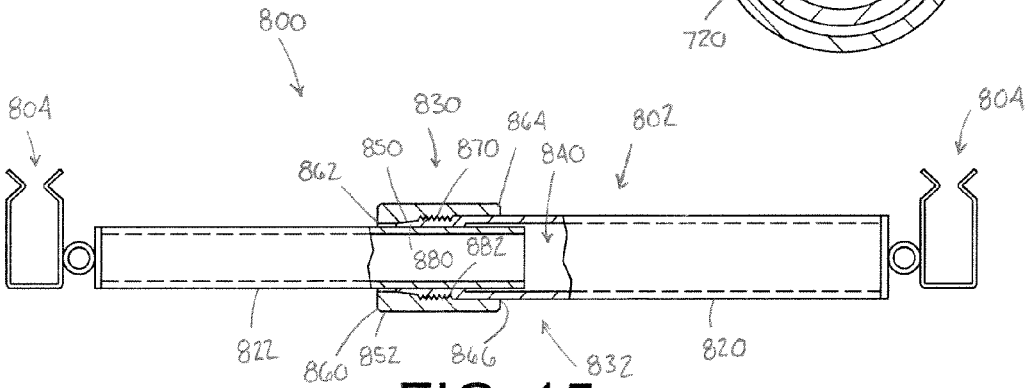
FIG. 15 is a top plan view, partially broken away, of a trestle stabilizing device according to a eighth aspect of the present disclosure.

In accordance with another aspect of the present disclosure, and as shown in FIG. 15, a trestle stabilizing device 800 generally comprises a longitudinally extending, adjustable base 802 and fastening members 804 pivotally secured to respective end sections of the base. The base includes a first elongated member 820 and a second elongated member 822 at least partially telescopically received in an interior 840 of the first elongated member. A locking structure 830 is coupled to an end section 832 of the first elongated member 820.

The locking structure 830 is generally cylindrical in cross-section and includes an inner surface 850 and an outer surface 852. The inner surface is inclined towards the outer surface such that a first end 860 of the locking structure includes an opening 862 having a first dimension and a second end 864 of the locking structure includes an opening 866 having a second, larger dimension. The interior surface 850 includes a threaded section 870. A resilient portion 880 of the end section 832 includes a threaded section 882. In use, as the second end 864 of the locking structure is slid onto the end section 832 of the first elongated member 820, the threaded section 870 engages the threaded section 882. As the locking structure is twisted, the locking structure will move further onto the end section 832, which, in turn, causes the first end 860 to engage the resilient portion 880. This forces the resilient portion into contact with the second elongated member 822, thereby preventing the longitudinal movement of the second elongated member within the interior of the first elongated member.

Figure 16:
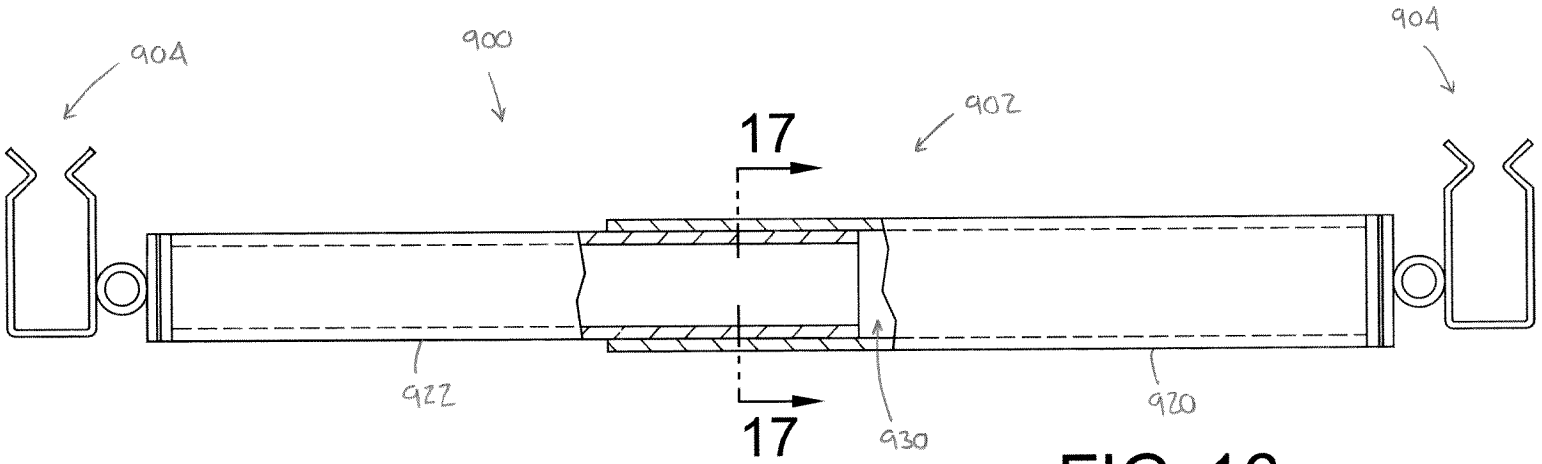
FIG. 16 is a top plan view, partially broken away, of a trestle stabilizing device according to a ninth aspect of the present disclosure.
Figure 17:
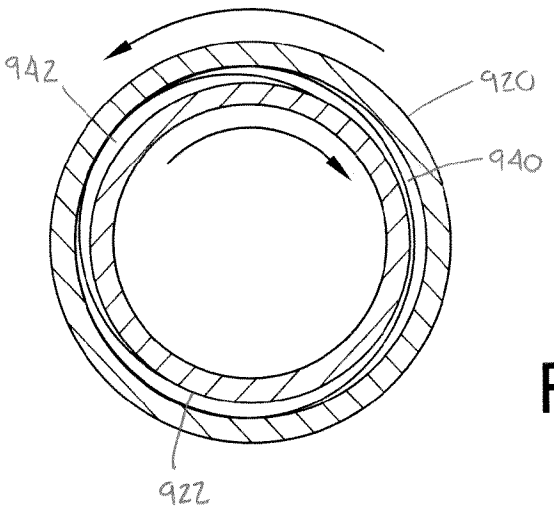
FIG. 17 is a cross-sectional view of the trestle stabilizing device of FIG. 16 taken generally along line 17-17 of FIG. 16.

In accordance with another aspect of the present disclosure, and as shown in FIGS. 16 and 17, a trestle stabilizing device 900 generally comprises a longitudinally extending, adjustable base 902 and fastening members 904 pivotally secured to respective end sections of the base. The base includes a first elongated member 920 and a second elongated member 922 at least partially telescopically received in an interior 930 of the first elongated member. In lieu of a separate locking structure, the first and second elongated members serve as the locking structure. Particularly, as shown in FIG. 17, the first and second elongated members 920 and 922 are generally cam-shaped and include respective lobes 940 and 942. In order to lock the second elongated member in a desired position in relation to the first elongated member, the first elongated member 920 is twisted in a first direction and the second elongated member 922 is twisted in a second, opposite direction. This causes the lobe 940 of the first elongated member 920 to engage the lobe 942 of the second elongated member 922.

Figure 18:
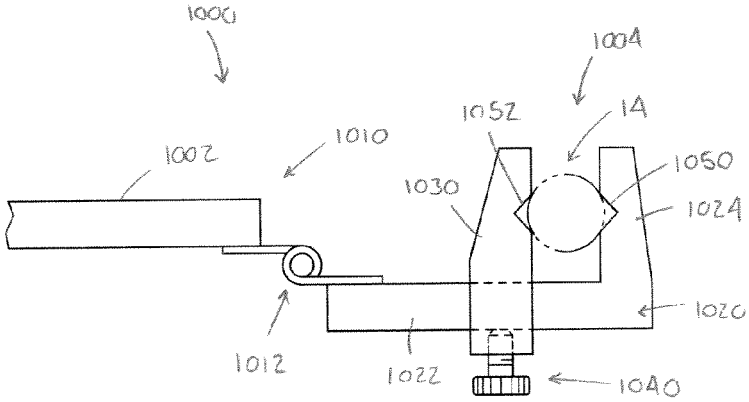
FIG. 18 is a partial top plan view of a trestle stabilizing device according to a tenth aspect of the present disclosure.
Figure 19:
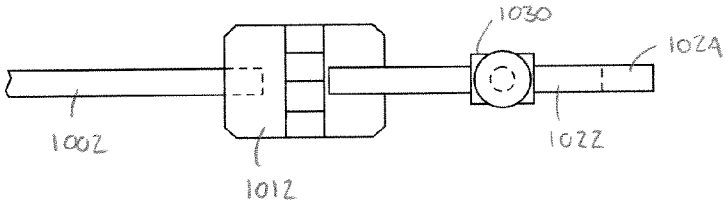
FIG. 19 is a partial side view of the trestle stabilizing device of FIG. 18.

In accordance with another aspect of the present disclosure, and as shown in FIGS. 18 and 19, a trestle stabilizing device 1000 generally comprises a base 1002, which can be axially adjustable. A fastening member 1004 is hingedly connected to each end portion (only right end portion 1010 is illustrated) of the base via a hinge member 1012. The fastening member includes a L-shaped stop member 1020. The stop member includes a leg 1022 and a first engagement member 1024 extending outwardly from the leg. A second engagement member 1030 is moveably or slidably mounted over the leg of the stop member. Alternatively, it should be appreciated that the second engagement member can be mounted directly to the hinge member 1012. In that instance, the stop member 1020 is moveable relative to the second engagement member. A locking structure 1040 is provided on the second engagement member for preventing the longitudinal movement of the second engagement member on the leg 1022 of the stop member 1020.

At least one of the first and second engagement members includes at least one notch for engaging the trestle. As shown, both the first and second engagement members 1024 and 1030 include a respective notch 1050 and 1052. In use, the trestle 14 is positioned between the first and second engagement members. The second engagement member is pressed against the trestle, the trestle being located in the notches. The locking structure engages the stop member 1020 to prevent axial movement of the second engagement member.

Figure 20:
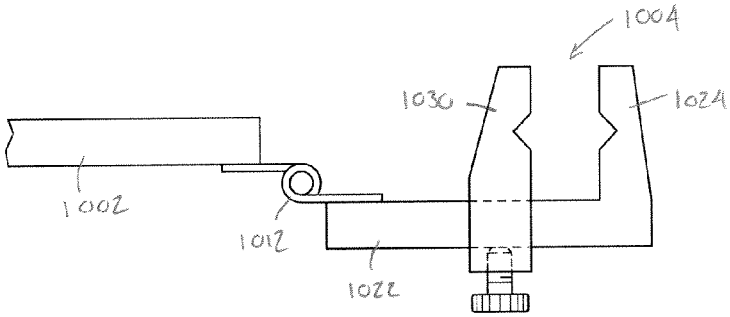
FIG. 20 is a partial top plan view of a trestle stabilizing device according to a eleventh aspect of the present disclosure.
Figure 21:
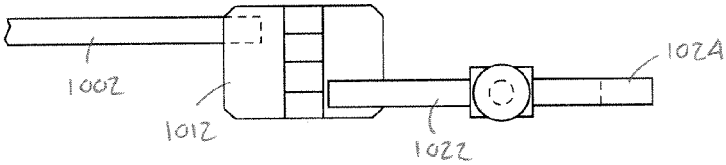
FIG. 21 is a partial side view of the trestle stabilizing device of FIG. 20.

In this embodiment, the base 1002 includes a longitudinal axis and the stop member 1020 includes a longitudinal axis. The longitudinal axis of the base is generally coaxial with the longitudinal axis of the stop member. Alternatively, as shown in FIGS. 20 and 21, the longitudinal axis of the base 1002 is offset from the longitudinal axis of the fastening member 1004. This allows the fastening member to swing over the base 1002.

Figure 22:
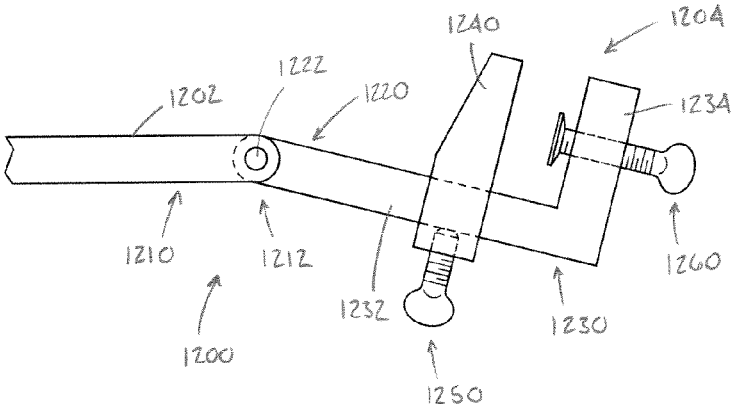
FIG. 22 is a partial top plan view of a trestle stabilizing device according to a twelfth aspect of the present disclosure.

In accordance with another aspect of the present disclosure, and as shown in FIG. 22, a trestle stabilizing device 1200 generally comprises a base 1202, which can be axially adjustable. A fastening member 1204 is hingedly connected to each end portion (only right end portion 1210 is illustrated) of the base via a hinge member 1212. In the depicted embodiment, the hinge member includes the end portion 1210 of the base and an end portion 1220 of the fastening member, the respective end portions being connected via a pivot pin 1222. The fastening member includes a L-shaped stop member 1230. The stop member includes a leg 1232 and a first engagement member 1234 extending outwardly from the leg. A second engagement member 1240 is moveably or slidably mounted over the leg of the stop member. A first locking structure 1250, such as a thumb screw, is provided on the second engagement member for preventing the longitudinal movement of the second engagement member on the leg 1232 of the stop member 1230. A second locking structure 1260, such as a thumb screw, is provided on the first engagement member 1234 for engaging the trestle.

The present disclosure has been described with reference to the above embodiment. Obviously, modifications and alterations will occur to others upon reading and understanding the preceding detailed description. For example, it should be appreciated that the present disclosure is suitable for use in other model track displays, such as model race car track displays. It is intended that the present disclosure be construed as including all such modifications and alterations as they come within the scope of the appended claims or the equivalents thereof.

What is claimed is:

1. A trestle stabilizing device for a model track assembly having support apparatuses for elevating track sections, the device comprising:

a base including a first end section and a second end section;

a first fastening member connected to the first end section by a first hinge member; and a second fastening member connected to the second end section by a second hinge member, wherein at least one of the first and second fastening members includes a first engagement member and a second engagement member, at least one of the first and second engagement members being biased towards the other of the first and second engagement members, and wherein the first and second fastening members releasably secure the trestle stabilizing device to adjacent track support apparatuses.

2. The device of claim 1, wherein the base includes a first elongated member and a second elongated member slidably mounted in relation to the first elongated member.

3. The device of claim 2, wherein the second elongated member is at least partially telescopically received by the first elongated member.

4. The device of claim 2, wherein the first elongated member includes a first longitudinal axis and the second elongated member includes a second longitudinal axis, the first longitudinal axis being generally coaxial with the second longitudinal axis.

5. The device of claim 2, further comprising a locking structure coupled to at least one of the first and second elongated members for selectively locking the second elongated member in a desired position in relation to the first elongated member.

6. The device of claim 1, wherein the base includes a first elongated member and a second elongated member at least partially telescopically received by the first elongated member, a portion of said second elongated member projecting from the first elongated member.

7. A trestle stabilizing device for a model track assembly having a plurality of trestles for elevating associated track sections, the device comprising:

a base including a first elongated member and a second elongated member, the second elongated member being slidably mounted in relation to the first elongated member;

a first fastening member pivotally connected to the first elongated member; and a second fastening member pivotally connected to the second elongated member, wherein at least one of the first and second fastening members includes a first engagement member and a second engagement member, at least one of the first and second engagement members being biased towards the other of the first and second engagement members, the first and second fastening members being configured to releasably secure the device to adjacent, spaced apart trestles to prevent toppling of one of the trestles relative to the other of the trestles and allow for a radius of curvature for the track sections thereby allowing the trestle stabilizing device to be connected to adjacent trestles associated with curved portions of the elevated track sections having various radii.

8. The device of claim 7, wherein at least one of the first and second fastening members includes a first engagement member and a second engagement member, the second engagement member being slidably mounted in relation to the first engagement member.

9. The trestle stabilizing device of claim 1, wherein the base includes a longitudinal axis and at least one of the first and second fastening members includes a longitudinal axis, the longitudinal axis of the base being generally coaxial with the longitudinal axis of the fastening member.

10. The trestle stabilizing device of claim 5, wherein the first and second elongated members prevent toppling of one of a first trestle and a second trestle relative to the other of the first trestle and second trestle.

11. The trestle stabilizing device of claim 10, wherein the first fastening member is pivotally connected to the first end section of the first elongated member and a second fastening member is pivotally connected to the second end section of the second elongated member, the first and second fastening members being configured to releasably secure the device to the first and second trestles.

12. The trestle stabilizing device of claim 2, wherein the first elongated member includes a hollow interior which accommodates at least a portion of the second elongated member.

13. The device of claim 7, wherein the first and second fastening members are pivotally connected to the respective first and second end sections of the base, wherein at least one of the first and second fastening members includes at least one notch for engaging the support apparatus.

14. The device of claim 7, further comprising a locking structure connected to the base for selectively locking the second elongated member in a desired position in relation to the first elongated member.

15. The device of claim 7, wherein the second elongated member is at least partially telescopically received by the first elongated member.

16. The device of claim 7, wherein the base includes a longitudinal axis and at least one of the first and second fastening members includes a longitudinal axis, the longitudinal axis of the base being generally coaxial with the longitudinal axis of the fastening member.

17. A trestle stabilizing device for a model track assembly having a plurality of trestles for elevating an associated track section, the device comprising:

a first elongated member having a first fastening member adapted to connect to a first trestle;

a first hinge member pivotally connecting the first elongated member to the first fastening member;

a second elongated member coupled to the first elongated member, the second elongated member having an end section adapted to connect to a second trestle;

a second hinge member pivotally connecting the second elongated member to a second fastening member; and a locking structure configured to selectively lock the second elongated member in a desired position in relation to the first elongated member, wherein at least one of the first and second fastening members includes a first engagement member and a second engagement member, at least one of the first and second engagement members being biased towards the other of the first and second engagement members, and wherein the first and second elongated members prevent toppling of one of the first and second trestles relative to the other of the first and second trestles.

18. The device of claim 17, wherein the second elongated member is telescopically received by the first elongated member.

19. The device of claim 18, wherein the first elongated member includes a hollow interior which accommodates at least a portion of the second elongated member.

20. The device of claim 17, wherein the locking structure comprising a portion of at least one of the first and second elongated members.

* * * * *